US006752365B2

(12) United States Patent
Vanech

(10) Patent No.: US 6,752,365 B2
(45) Date of Patent: Jun. 22, 2004

(54) HANGER FOR HANGING OBJECTS FROM A VERTICALLY EXTENDING STRUCTURE

(76) Inventor: Anthony T. Vanech, 22 Edgewood Rd., Darien, CT (US) 06820

( * ) Notice: Subject to any disclaimer, the term of this patent is extended or adjusted under 35 U.S.C. 154(b) by 0 days.

(21) Appl. No.: 10/167,855

(22) Filed: Jun. 12, 2002

(65) Prior Publication Data

US 2002/0195529 A1 Dec. 26, 2002

Related U.S. Application Data

(60) Provisional application No. 60/300,040, filed on Jun. 21, 2001.

(51) Int. Cl.[7] ..... A47G 29/00
(52) U.S. Cl. ..... 248/218.4; 248/230.9
(58) Field of Search ..... 248/218.4, 219.3, 248/219.4, 230.8, 230.9

(56) References Cited

U.S. PATENT DOCUMENTS

| | | | | | |
|---|---|---|---|---|---|
| 568,905 | A | * | 10/1896 | Holmes | 211/110 |
| 753,446 | A | * | 3/1904 | Swartwout | 211/107 |
| 1,342,626 | A | * | 6/1920 | Frank | 211/107 |
| 1,441,913 | A | * | 1/1923 | Darling | 211/107 |
| 1,648,220 | A | * | 11/1927 | Gerow et al. | 248/541 |
| 1,730,732 | A | | 10/1929 | Jacobs | |
| 1,787,150 | A | * | 12/1930 | Gerow et al. | 24/271 |
| 1,832,276 | A | * | 11/1931 | Blunt | 105/37 |
| 2,757,458 | A | * | 8/1956 | Zipser | 33/373 |
| 2,759,695 | A | * | 8/1956 | Berner et al. | 248/95 |
| 3,332,654 | A | | 7/1967 | Jacobson | 248/221 |
| 3,785,604 | A | | 1/1974 | Steck | 248/231 |
| 3,894,707 | A | | 7/1975 | Heard | 248/231 |
| 4,117,629 | A | | 10/1978 | Ekdahl | 47/67 |
| 4,132,336 | A | * | 1/1979 | Leinaar | 224/42.13 |
| 4,186,468 | A | * | 2/1980 | Zaniewski | 24/483 |
| 4,382,570 | A | * | 5/1983 | Craig | 248/74.3 |
| 4,409,907 | A | * | 10/1983 | Norton | 108/152 |
| 4,635,888 | A | | 1/1987 | Aldridge et al. | 248/231 |
| 5,259,141 | A | | 11/1993 | D'Alessandro | 47/39 |
| 5,292,014 | A | | 3/1994 | Lelong | 211/88 |
| 6,202,964 | B1 | | 3/2001 | Thornhill | 248/219.4 |

* cited by examiner

*Primary Examiner*—Leslie A. Braun
*Assistant Examiner*—Kofi Schulterbrandt
(74) *Attorney, Agent, or Firm*—St. Onge, Steward Johnston & Reens LLC

(57) ABSTRACT

The invention relates to a toolless hanger including a securing mechanism having a plurality of holes, a proximal end, and a distal end. The hanger also includes a first hole attachment being attached to one of the plurality of holes located at approximately the distal end, a second hole attachment being attached to another of the plurality of holes located at approximately the proximal end, and a closing mechanism for securing the first hole attachment to the second hole attachment.

8 Claims, 4 Drawing Sheets

HANGER FOR HANGING OBJECTS FROM A VERTICALLY EXTENDING STRUCTURE

RELATED APPLICATION

This Application claims priority from U.S. Provisional Patent Application No. 60/300,040, filed Jun. 21, 2001.

FIELD OF THE INVENTION

The invention relates to a hanger for hanging objects from a vertically extending structure.

BACKGROUND OF THE INVENTION

Conventional hangers that attach to articles, such as trees and posts, generally involve fasteners that injure or damage the article. Furthermore, some conventional hangers may require tools to attach, remove, and adjust the hangers. Further, other typical hangers have a multitude of fasteners or complex securing mechanisms that may render these hangers difficult and/or time consuming to use.

U.S. Pat. No. 1,730,732 to Jacobs discloses a boiler support having a metal band that wraps around the boiler that is secured with a nut and bolt attached to flanges in the metal band. For adjustment purposes, the band may have slots in it and an end of the band may have a gradually tapering portion that suddenly expands, at the very tip, to a rounded head. The rounded head is normally inserted into a slot and typically held in place between the head and gradually tapering end. A disadvantage of this invention is that the band is weakened due to the adjustment mechanism. The slots in the band as well as the tapered end remove material from the band and may negatively affect the band's structural integrity.

U.S. Pat. No. 1,441,913 to Darling also relates to a boiler support. Similar to the above reference, this invention relates to a metal band that typically wraps around the boiler and may be secured with a nut and bolt attached to flanges in the metal band. The adjustment mechanism typically involves placing multiple slots in the metal band and positioning an end of the metal band, having a shape of a loop, in a particular slot. Adjustments to the band's diameter is possible upon placing the looped end in varying slots. Similar to the above reference, this invention's adjustment mechanism may weaken the overall structural integrity of the metal band because the slots remove material from the band. Moreover, the slots do not appear to be holes but are notches extending from an outer surface of the band into the band's material. This configuration may also contribute to the band's weakness.

Both references have limited abilities to support weight hanging from the bands because the bands can fail due to the above mentioned weaknesses in structural integrity.

What is desired, therefore, is an adjustable hanger permitting weight to be hung from it without sacrificing structural integrity.

SUMMARY OF THE INVENTION

Accordingly, it is an object of the invention to provide an adjustable hanger for securely hanging objects.

Another object of the invention is to provide an adjustable hanger having multiple adjustments for major and minor adjustments.

A further object of the invention is to provide an adjustable and toolless hanger.

These and other objects of the invention are achieved by provision of a securing mechanism having a plurality of holes, a proximal end, and a distal end. The hanger also includes a first hole attachment being attached to one of the plurality of holes located at approximately the distal end, a second hole attachment being attached to another of the plurality of holes located at approximately the proximal end, and a closing mechanism for securing the first hole attachment to the second hole attachment.

In certain embodiments, the hanger further includes a second closing mechanism for finely adjusting a distance between the first hole attachment and the second hole attachment. In certain other embodiments, the hanger includes at least one extension extending from the securing mechanism for hanging an object from a cantilevered end.

In another embodiment of the invention, the hanger includes a securing mechanism having a proximal end and a distal end, a closing mechanism for securing the proximal end to the distal end, at least one extension extending from the securing mechanism for hanging an object from a cantilevered end, a pilot hole located on the at least one extension; and a guiding member located on the securing mechanism for positioning the at least one extension relative to the securing mechanism.

In certain embodiments, the hanger includes a recess located on the securing mechanism for further positioning the at least one extension relative to the securing mechanism.

The invention and its particular features and advantages will become more apparent from the following detailed description with reference to the accompanying drawings.

DETAILED DESCRIPTION OF THE DRAWINGS

Figure 1:
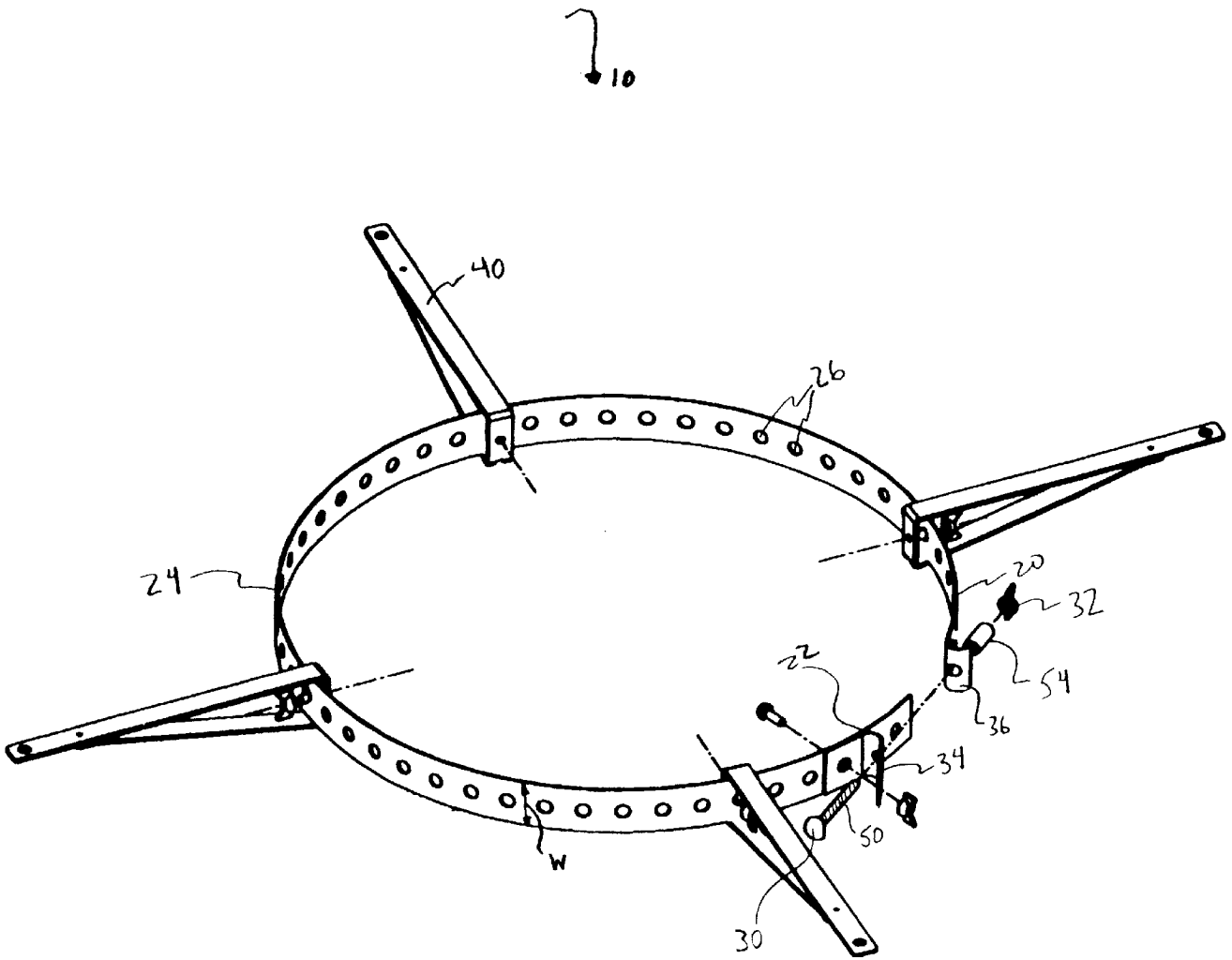
FIG. 1 depicts one embodiment of a hanger in accordance with the invention.

FIG. 1 depicts one embodiment of a hanger in accordance with the invention. Hanger 10 is for hanging objects from the ends the extensions 40, such as a plant, ornament, bird feeder, or any object that is capable of being hung from extension 40. Although one extension 40 may be used, the invention envisions multiple extensions 40 being used to possibly hang several objects simultaneously.

In a preferred embodiment, securing mechanism 24 substantially encompasses a generally circular article, such as a tree, lamp post, telephone pole, decking post, and the like. Friction, in addition to the first and second closing mechanisms, between securing mechanism 24 and the article inhibits securing mechanism 24 from sliding downwardly. Securing mechanism 24 includes a plurality of holes 26 for adjusting the circumference, and diameter, of securing mechanism 24 about the article. Plurality of holes 26 also provides locations to which extensions 40 are connected radially about securing mechanism 24. Securing mechanism 24 having a larger width, shown by dimension W, increases friction between securing mechanism 24 and the article and, thus, further inhibits securing mechanism 24 from sliding downwardly when secured to the article. Although plurality of holes 26 are shown to be thru-holes, other embodiments may use holes that do not penetrate completely through securing mechanism 24.

The circumference of securing mechanism 24 is adjusted by varying the location of hole attachment 34, which is attachable to any one of the plurality of holes 26. Hole attachment 34 is thereafter connected to bend 36 via bolt 30 and nut 32, which in turn tightens securing mechanism 24 about the article. As shown, bend 36 extends from a proximal end 20 of securing mechanism 24. In this embodiment, bend 36 is a formed, or bent, portion of proximal end 20. In other embodiments, bend 36 has the same limitations as attachment 34. In further embodiments, bend 36 is permanently attached to proximal end 20. As shown, bend 36 has the same shape as attachment 34. However, this is not required. All that is required is that both attachment 34 and bend 36 each have an orifice, through which bolt 30 passes so as to connect attachment 34 and bend 36 together. Further, because plurality of holes 26 are located along a length of securing mechanism 24, they provide the ability to greatly vary the circumference of securing mechanism 24. Hence, major adjustments to the circumference or diameter of securing mechanism 24 is accomplished by altering to which hole 26 hole attachment 34 attaches.

Hole attachment 34 attaches to hole 26 in any known or novel manner, such as threaded engagement via wingnut 32 and bolt 30 or any other type of fastening system. A user selects which hole 26 attachment 34 attaches such that, when distal end 20 and proximal end 22 of securing mechanism 24 are joined as described above, securing mechanism 24 forms a snug fit about the article. Attachment 34 is shown to be a curved, rigid material having at least two holes, one hole for attaching to hole 26 and one hole for permitting bolt 30 to pass through. In other embodiments, attachment 34 may comprise an "L" shaped member. Attachment 34 and securing mechanism 24 are preferably made of metal but may be any rigid material having structural integrity to support objects being hung from extension 40, such as plastic, wood, fiberglass, synthetic materials, and the like.

Optionally, spacer 54 may be used to distance nut 32 from bend 36 because the curved geometry of bend 36 or the close proximity to securing mechanism 24 may cause difficulty in turning nut 32, which tightens or loosens nut 32.

It should be understood that attachment 34 and bend 36 need not be attached by a bolt and nut. In certain embodiments, attachment and bend 36 are attached together by a buckle and clasp and, in other embodiments, a tongue and groove mechanism. All that is required of the invention is that it provide a device to couple distal end 20 and proximal end 22 together, thereby attaching securing mechanism 24 to the article.

Extensions 40, as shown, are protruding arms that attach to and extend from securing mechanism 24. As shown, there may be a multitude of extensions 40 for hanging numerous objects from hanger 10. An extension 40 is fastened to securing mechanism 24 by a bolt 30 and nut 32 through one of the plurality of holes 26. Extension 40 has an orifice through which a bolt passes and couples to one of plurality of holes 26. In other embodiments, a clamp is used. In certain other embodiments, magnets are used to secure extension 40 to securing mechanism 24. Magnets may also be used in first and second closing mechanisms to adjust the distance between distal and proximal ends, 20 and 22. The distance extension 40 extends from securing mechanism 24 varies according to the size of the objects being hung from extension 40.

Minor adjustment mechanism 50 provides minor, or fine, adjustments of the securing mechanism's diameter relative to placement of attachment 34. Minor adjustment mechanism 50 is the threads of bolt 30. The distance between distal end 20 and proximal end 22 is adjusted by turning nut 32 or bolt 30 as the bolt's threads are engaged with nut 32. Preferably the threads run the length of bolt 30. In other embodiments, the threads run over a portion of bolt 30.

Hanger 10 is particularly beneficial because it does not harm the article to which hanger 10 is attached. In the case where the article is a tree, hanger 10 further permits a form of automatic minor adjustment for tree growth due to the flexibility of attachment 34 and bend 36. When the tree expands in girth, it puts tension on securing mechanism 24. As a result, attachment 34 and/or bend 36 automatically bends, or flexes, to accommodate the tree growth without user intervention. The flexing generally occurs in the area of attachment 34 and bend 36 that extend radially away from securing mechanism 24. Depending on the thickness of the material used, attachment 34 and bend 36 may flex more or less.

As shown, hanger 10 is utilized without tools. This is advantageous because the invention is readily adjustable without the need for the user to purchase or operate cumbersome and expensive tools. However, this should not be a limitation to the invention because in other embodiments, tools are used to adjust fasteners used to secure extension 40 to securing mechanism 24 or make major and/or minor adjustments to the circumference of securing mechanism 24.

Figure 2:
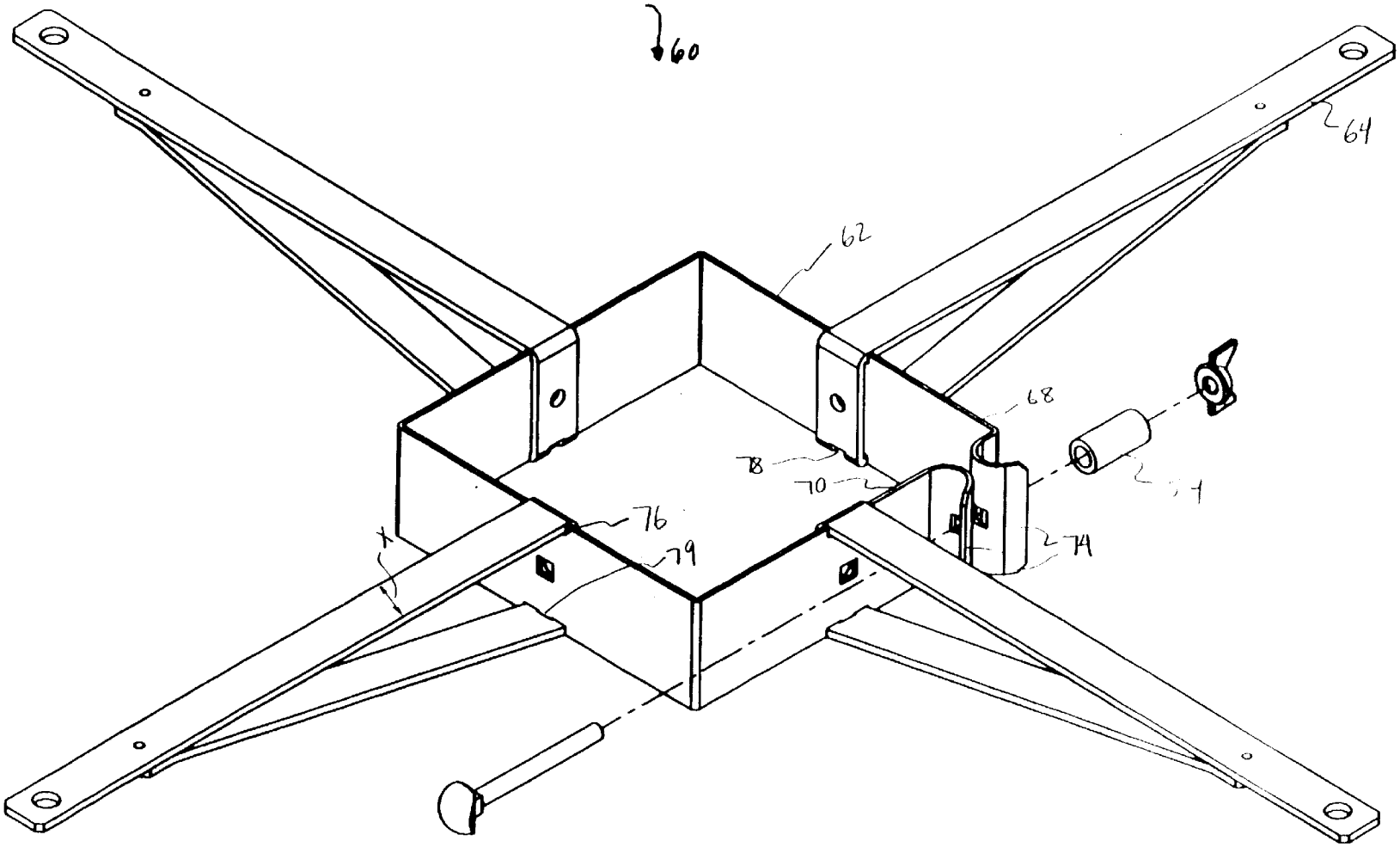
FIG. 2 depicts another embodiment of the hanger having a pilot hole and guiding member for positioning the extensions.

In another embodiment of the invention, shown in FIG. 2, hanger 60 is attachable to a square shaped article, such as a post. Hanger 60 includes securing mechanism 62, extensions 64, proximal end 68, distal end 70, and closing mechanism 74. Closing mechanism 74 is permanently attached in a fixed position to proximal and distal ends, 68 and 70. In certain embodiments, closing mechanism 74 is not a separate piece affixed to securing mechanism but is a molded, or formed, portion of securing mechanism 62. Hanger 60 lacks a major adjustment mechanism because posts are generally of a standard size and the size of securing mechanism 62 and hanger 10 may be predetermined. To accommodate varying standard sized posts, securing mechanism 62 will be manufactured in various, predetermined sizes.

However, minor adjustment is provided to accommodate small variances in size and to provide tension on the post. Similar to the embodiment described under FIG. 1, hanger 60 permits automatic minor adjustments due to the flexibility of closing mechanism 74. If the post expands, such as due to water damage or sun, it puts tension on securing mechanism 62. As a result, closing mechanism 74 automatically bends, or flexes, to accommodate the growth without user intervention. The flexing generally occurs in the area of closing mechanism 74 that extend radially away from securing mechanism 24. Depending on the thickness of the material used, closing mechanism 74 may flex more or less.

To position extension 64 on securing mechanism 62, recess 76 in securing mechanism 62 is sized to accommodate a width X of extension 64. In addition, pilot hole 78 in extension 64 and guiding member 79 located on securing mechanism 62, pilot hole 78 being sized to fit guiding member 79, inhibit extension 64 from moving downwardly when an object is hung from extension 64. In other embodiments, recess 76 is absent and pilot hole 78 and guiding member 79 act to position as well as inhibit downward movement of extension 64.

Figure 3:
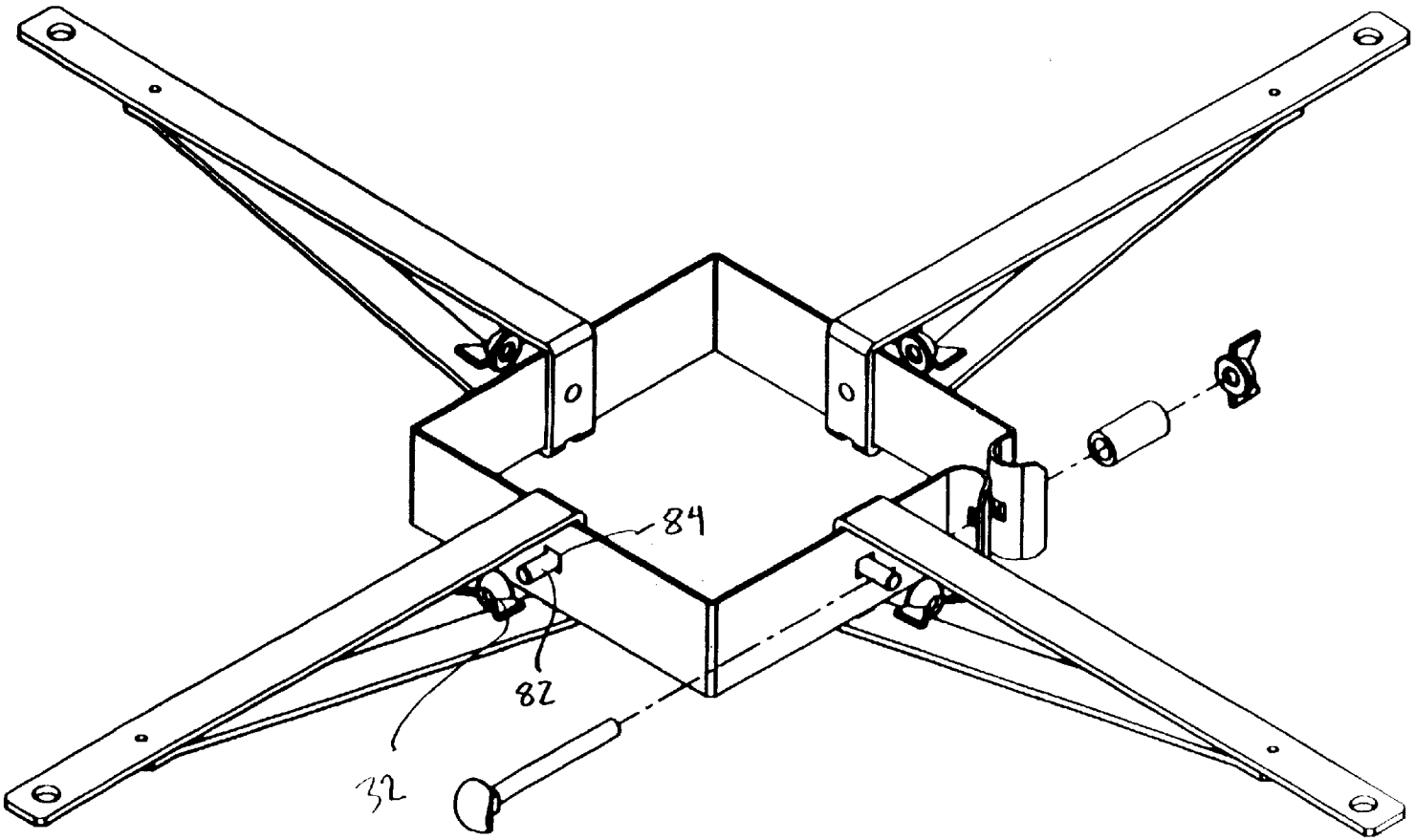
FIG. 3 depicts another embodiment of the hanger having a pin and receiving hole for securing the extensions to the securing mechanism.

FIG. 3 shows another embodiment of the invention where hanger 60 further includes a pin 82 located on extension 64 and a receiving hole 84 located on securing mechanism 62 to receive pin 82. Pin 82 and receiving hole 84 position extension 64 onto securing mechanism 62 and obviate the desire for recess 76, pilot hole 78, and guiding member 79. Optionally, nut 32 may be used if pin 82 is threaded. This provides an added measure for securing extensions 64 to securing mechanism 62.

Figure 4:
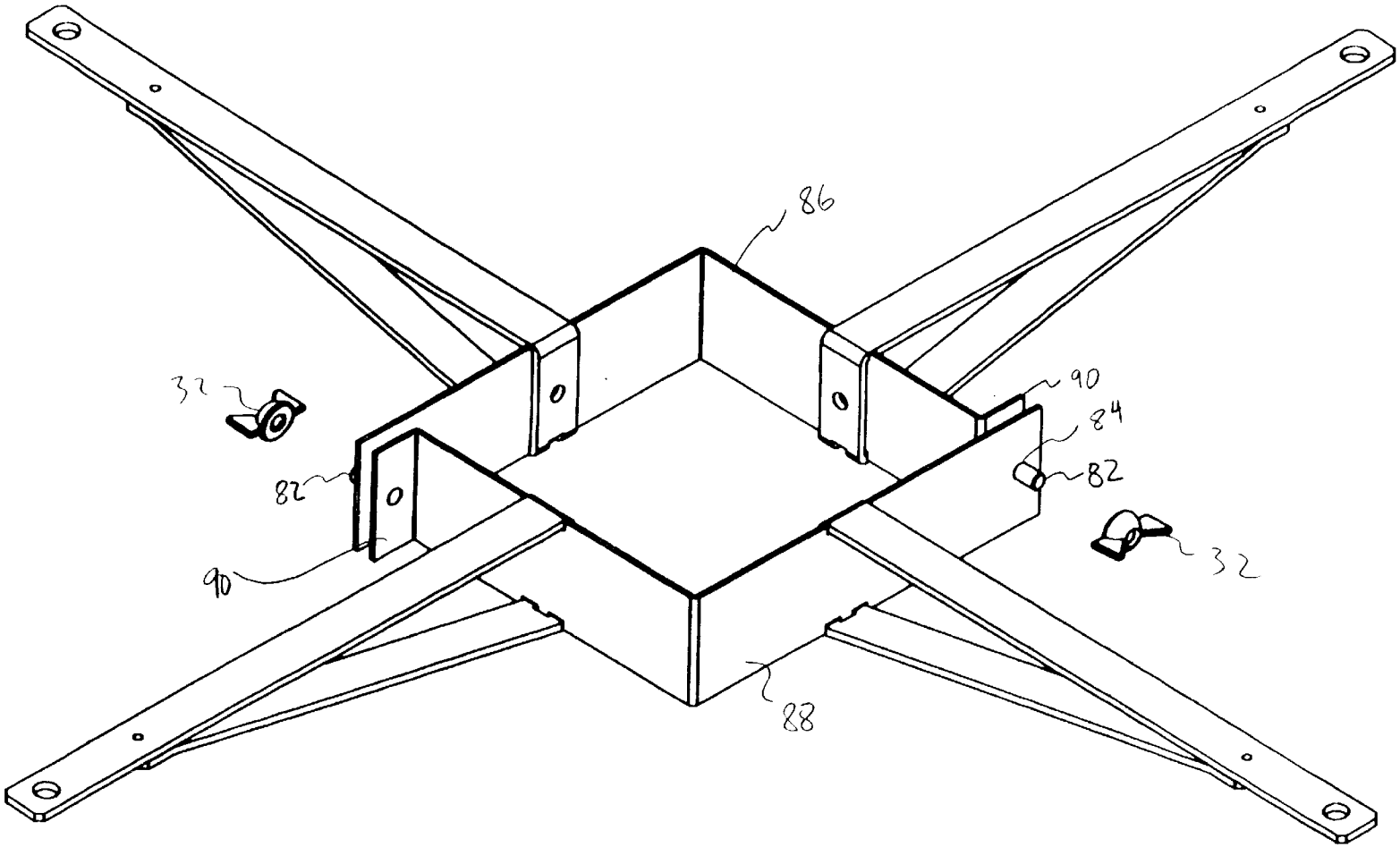
FIG. 4 depicts another embodiment of the hanger having a separable securing mechanism.

FIG. 4 shows a further embodiment of hanger 60 where securing mechanism 62 is divided into two sections, first section 86 and second section 88. Both first and second sections are flanged at one end 90 with a pin 82 located on the flanged end 90 and a receiving hole 84 located at the opposite end. Pin 82 and hole 84 facilitate proper alignment between first and second sections, 86 and 88. Moreover, pin 82 is threaded and nut 32 attaches to pin 82 so as to prevent first and second sections, 86 and 88, from separating. Such a configuration permits an alternative way to secure securing mechanism 62 to the article, or post.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A hanger, comprising:

a securing mechanism having a proximal end, a distal end, and a plurality of thru-holes spaced apart along a length of said securing mechanism;

at least one extension extending radially from said securing mechanism;

a hole attachment separable from but being attached to one of said plurality of thru-holes located at approximately said distal end;

a first threaded fastener passing through said securing mechanism and said hole attachment for securing said hole attachment to said securing mechanism;

said at least one extension being attached to another one of said plurality of thru-holes;

a second threaded fastener passing through said securing mechanism and said at least one extension for securing said at least one extension to said securing mechanism;

said proximal end further comprising a bend;

a threaded connector connecting said hole attachment to said bend; and a nut engaged with each of said first and second threaded fasteners for securing said hole attachment and said at least one extension to said securing mechanism;

wherein a major adjustment is accomplished by attaching said hole attachment to various holes of said plurality of thru-holes;

wherein a minor adjustment is accomplished by rotating said threaded connector, thereby varying a distance between said hole attachment and said bend;

wherein an additional minor adjustment is accomplished by exerting tension on said securing mechanism, thereby causing a portion of said hole attachment and a section of said bend to flex.

2. The hanger according to claim 1, further comprising a threaded fastener passing through said securing mechanism and said hole adjustment for securing said hole adjustment to said securing mechanism.

3. The hanger according to claim 2, further comprising a nut engaged with said threaded fastener for securing said hole attachment to said securing mechanism.

4. The hanger according to claim 3, wherein said nut is a wingnut so as to obviate a need for tools for securing said hole attachment to said securing mechanism.

5. The hanger according to claim 1, wherein said at least one extension cantilevers off from said securing mechanism for hanging objects from the cantilevered end.

6. The hanger according to claim 1, further comprising a recess located on said securing mechanism for further positioning said at least one extension relative to said securing mechanism.

7. A hanger, comprising:

a securing mechanism having a proximal end and a distal end;

said proximal end having a bend and an orifice;

said distal end having a curve and an aperture;

a threaded connector placed through both said orifice and said aperture for securing said bend to said curve;

at least one extension having a horizontal member extending radially from said securing mechanism for hanging an object from a cantilevered end, a vertical member extending along a surface of said securing mechanism and being generally perpendicular to said horizontal member, and a supporting member being angularly related to and connecting both said horizontal member and said vertical member for inhibiting downward movement of said at least one extension when hanging the object from the cantilevered end;

a guiding mechanism located on said securing mechanism for positioning said at least one extension relative to said securing mechanism;

wherein said guiding mechanism is selected from the group consisting of a recess on a top-most peripheral edge of said securing mechanism sized to fit a width of said at least one extension, a protrusion extending from a top-most peripheral edge of said securing mechanism, and combinations thereof;

wherein a minor adjustment is accomplished by rotating said threaded connector, thereby varying a distance between said bend and said curve; and wherein an additional minor adjustment is accomplished by exerting tension on said securing mechanism, thereby causing a portion of said bend and a section of said curve to flex.

8. The hanger according to claim 7, said at least one extension includes a hole for mating with said protrusion to facilitate positioning said at least one extension relative to said securing mechanism.

* * * * *